United States Patent [19]

Bergamini

[11] 4,161,832

[45] Jul. 24, 1979

[54] SEVEN-SEGMENTED ELECTROMECHANICAL DIGITAL INDICATOR

[75] Inventor: Giorgio Bergamini, Bari, Italy

[73] Assignee: Nuovo Pignone S.p.A., Italy

[21] Appl. No.: 870,325

[22] Filed: Jan. 18, 1978

[30] Foreign Application Priority Data

Feb. 1, 1977 [IT] Italy ..... 19834 A/77

[51] Int. Cl.[2] ..... G09F 13/28

[52] U.S. Cl. ..... 40/451; 40/466

[58] Field of Search ..... 40/447, 450, 449, 451, 40/448

[56] References Cited

U.S. PATENT DOCUMENTS

| | | | |
|---|---|---|---|
| 2,814,893 | 12/1957 | Aiken | 40/447 |
| 2,922,993 | 1/1960 | Sack | 40/450 |
| 3,096,594 | 7/1963 | Skrobisch | 40/451 |
| 3,250,031 | 5/1966 | Bowman | 40/447 |
| 3,516,724 | 6/1970 | Ashton | 40/451 X |
| 3,991,496 | 11/1976 | Helwig | 40/449 |

*Primary Examiner*—Louis G. Mancene
*Assistant Examiner*—Wenceslao J. Contreras
*Attorney, Agent, or Firm*—Morgan, Finnegan, Pine, Foley & Lee

[57] ABSTRACT

An electromechanical digital indicator for displaying numerical information is disclosed, in which the angular movements of seven movable segments, combined with the action of a block in the shape of an eight and made of a transparent and light-channelling plastics material, acts in such a way as to display any figure at choice from zero to nine in solid lines rather than in segmental form, contrary to what occurs with the conventional display devices. Fluorescent layers on the bottom wall of the block and other expedient render the display visible under any conditions of direct or indirect lighting and also in the darkness of the night. Internal illumination means can be provided in the inside of the indicator box, that which could not be obtained heretofore with the electromechanical digital display appliances.

6 Claims, 5 Drawing Figures

SEVEN-SEGMENTED ELECTROMECHANICAL DIGITAL INDICATOR

This invention relates to a novel seven-segmented electromechanical digital indicator which, by adopting quite an original magnetic circuit for controlling the angular strokes of said segments, by composing the desired number in such a way as to have the segments aforesaid acting in the sense of properly unmasking a complete figure of eight in color and affording the possibility of exploiting an internal light source, requires a low consumption of electric power for the control, a high working speed, a low first cost while concurrently permitting an improved aesthetic aspect together with a better visibility in comparison with the conventional products of the same genus.

As is known, the digital indicators are based on the principle that all the numbers from 0 to 9 can be composed by using the figure of eight as a matrix.

The state of the art has disclosed a number of different kinds of digital indicators. The most well known among these are the so called luminous indicators (by incandescence, luminescence, luminous diodes, gas discharge and so forth) in which the basic number eight is provided on a supporting plate with seven discrete segments which are arranged like the sides of two superposed parallelograms, whereas all the other numbers are displayed by lighting a number of segments of less than seven according to an electronically programmed logic so that the lighted segments display and are the most closely possible similar to the Arabic numerical characters from zero to nine.

Such luminous indicators afford considerable advantages. As a matter of fact, they have so low electricity demand that they do not require any power stage for piloting them and, moreover, a number of luminous indicators can be driven in sequence directly by a single electronic control circuitry. On the other hand, such indicators are so speedy that the expedient is currently adopted of piloting them sequentially, one at a time, at a high frequency, by exploiting the phenomenon of the persistence of vision. These indicators, however, are affected by some defects, one of which is due to the fact that the displayed number is always broken into segments rather than in a solid line, the result being an impairment both of the legibility and appearance. In addition, their legibility becomes very defective in the presence of sunlight directly impinging thereon, they do not permit a storage of the displayed number also when no feeding voltage is present and, lastly, they involve a continuous consumption of power even when the displayed number is not changed.

These shortcomings are partially offset by the seven-segmented electromechanical indicators known in the art, which have solved the problem of displaying a segmented figure which can be viewed also under reflected light.

These conventional electromechanical digital indicators are constituted, each, by a black mask or plate having seven slits or windows arranged, somewhat in a figure-of-eight pattern as outlined above, beneath which movable members having bright colors are caused to appear or disappear, so as to make up the aforesaid segments which compose the number concerned.

Stated another way, in such indicators, the numbers are no longer obtained by lighting up segments, but rather by the appearance of colored movable elements or segments beneath corresponding window of the mask aforementioned. On the other hand, the appearance of the colored elements or segments according to a logical sequence capable of displaying all the numbers from zero to nine, is achieved by the instrumentality of an angular stroke of each colored movable member of the indicator from a stable position corresponding to an out-of view or reset segment, to another equally stable position which corresponds to an in-view or active segment, such as movement being produced by a current pulse which is properly caused to flow through the energization coil of an electromagnet which magnetically cooperates with a permanent magnet, the latter being integral with said colored movable segment. More exactly, according to the conventional art, each colored movable segment of the electromechanical indicator is integral with magnetization of the head and which is hinged eccentrically along its central axis and beneath which magnet the pole shoe of an electromagnet is confrontingly mounted. The rotation of such a magnet, and thus, of the colored segment is restricted by two mechanical abutments which define the two stable positions aforementioned.

It is apparent, in fact, that, consistently with the direction of the current flowing through the energization coil of the electromagnet, there will appear on the pole shoe of the electromagnet either a South magnetization or a North magnetization which will suck the magnetized end of the magnet having the opposite polarity, the magnet being thus compelled to rotate towards either of the two stable positions aforesaid.

Now, since the colored movable segments remain always in their stable position that they have reached and from which they can be withdrawn only by a fresh and appropriate current pulse, it is apparent that the electromechanical digital indicators permit the storage of the displayed number even if no feed voltage is present and, in addition, they do not use up electricity if the number is not changed. On the other hand, since the displayed number is now read out by reflected light, the presence of sunlight impinging therein improves their readability.

Such conventional electromechanical digital indicators are affected, however, by considerable drawbacks. The most serious of these defects is due to the apparently low efficiency of the magnetic circuit, on account of the presence of a wide gap between the electromagnet and the permanent magnet and the fact that the magnetic flux is linked entirely in air. So low an efficiency thus imposes that the colored movable segments are piloted with curre-nt pulses of a considerable intensity, the result being that the indicators cannot directly be driven by the electronic driving unit but, rather, through power stages so that the first costs are increased. On the other hand, the eccentric hinge of the permanent magnets which are integral with the colored movable segments originates a certain moment of inertia which is a bar against the achievement of short switching times: the results is thus that a sequential command of the indicators by a single electronic decoding and driving system is not feasible, contrary to what occurs with the luminous indicators.

Other defects of the electromechanical digital indicators of the prior art are of an aesthetic and legibility nature and also of visibility in night time. As a matter of fact, also in these indicators, the displayed numbers are viewed segmentarily rather than in solid lines and, moreover, since the numbers are composed by the appearance, in correspondence with such windows of the black mask or plate, of brightly colored movable segments which, whenever necessary, are concealed beneath such mask, no possibility at all is afforded of applying a light source internally so as to lighten only the number-forming segment inasmuch as the light of said internal source would lighten also the mask windows which are not, indicators of this kind do not permit to see the displayed number in the darkness unless an external light source is resorted to.

An object of the present invention is to do away with the shortcomings aforementioned while then providing a seven-segmented electromechanical digital indicator of the kind referred to above which can be driven with low current pulses and has very short switching times so that a number of such indicators may be directly driven by a single electronic control circuitry without any intermediate power stages, and which displays digits in solid lines rather than in segmental pattern and permits that an internal light source may be used.

These objects are substantially achieved by exploiting for the angular shift of said movable segments a high-efficiency electromagnetic circuitry and by virtue of the permanent magnets integral with said segments which are hinged centrally rather than eccentrically, and due to the fact that the members are no longer formed by appearance of said movable segments but by partial or total unmasking by such movable segments of an underlying "number eight" which is brightly colored so that, in addition to obtaining numbers which are displayed in solid lines rather than in a fragmentary pattern with a consequent benefit of aesthetic appearance and legibility, it becomes also possible to illuminate the underlying "number eight" figure with an internal light source.

More detailedly, according to a feature of the present invention, the electromagnetic control circuit of the angular shift of each movable segment from a stable position corresponding to an "out-of-view" segment to another equally stable position corresponding to an "in-view" segment, or vice versa, is constituted by a permanent magnet which, integral with such movable segment, is hinged centrally relative to its central axes between the two pole shoes of an electromagnet which is substantially U-shaped, said shoes being in confronting relationship with the respective two frontal magnetized ends of such permanent magnet and encompass such ends along the entire arc of circle as drawn by said angular displacement of the movable segment which is integral with said permanent magnet.

The advantages and the high efficiency of such an electromagnetic circuit are conspicuous. As a matter of fact, since the head-magnetized ends of the permanent magnet are always confrontingly very near the pole shoes of the electromagnet so that there is a tiny and constant air gap and thus the magnetic losses are extremely low, the angular displacement of the permanent magnet which is integral with the movable magnet can now be obtained with current pulses of a low intensity. On the other hand, the presence of two pole shoes which are in confronting relationship relative to the two front magnetized ends of the permanent magnet, generates a twofold magnetic effect on the permanent magnet inasmuch as both the ends thereof are simultaneously and respectively rejected or sucked by the magnetic action of the poleshoes, and this fact permits that the intensity of the current pulses required for carrying out such an angular displacement be further reduced, the result being that the digital indicator can now directly be driven by the electronic control unit without requiring any intermediate power stages. In addition, the hinged connection which is no longer eccentric but is centrical of the permanent magnet minimizes the moment of inertia of the magnet and enables the movable magnet to be switched from a stable position to the other within a shortest time and this fact affords the possibility of driving sequentially a number of digital indicators with a single electronic decoding and driving system.

Summing up, such a magnetic circuit permits to achieve, for the electromechanical digital indicators, the advantages which are inherent in the luminous indicators.

Furthermore, according to a modification of the present invention, the permanent magnet integral with the movable segment and centrally hinged relative to its central axes, cooperates with an electromagnet which is substantially in the form of a 'T' and the ends of the wing of the 'T' are extended upwards into two pole shoes which are in confronting relationship relative to the magnetized front ends of the permanent magnet but do not encompass them completely along the entire arc of circle corresponding to the angular stroke of the movable segment which is integral with the permanent magnet.

This alternative embodiment of the magnetic circuit has also the twofold magnetic effect recalled hereinabove but is obviously less efficient that the former on account of the more intensive flux linking in air. It has, nevertheless, the considerable advantage of being easier both to construct and to assemble and permits a greater economy of materials as compared with the former embodiment.

According to yet another embodiment of the present invention and in order that the advantages aforementioned may be maintained while retaining the twofold magnetic effect outlined above, the permanent magnet which is integral with the movable segment and is hinged centrally relative to its central axes, cooperates with an electromagnet very much in the shape of a 'T' which has two pole shoes in respective correspondence with the two bevel top ends of the wing of the 'T', said permanent magnet being magnetized no longer in accordance with its front ends, but, rather, in correspondence with its bottom side ends which confront the pole shoes.

According to still a further feature of the present invention, the seven slits or windows formed through the top plate of the box of the electromechanical digital indicator, which are arranged in the shape of a figure of eight like the sides of two superposed parallelograms, are extended the one into the other so as to make up a single continuous window or slit in the shape of an "eight," in correspondence with which and beneath such movable segments, there is mounted in the interior of the box a small block of a transparent plastics material which is light-conductive and is shaped in the figure of eight outline in a manner similar to that of said single slit or window, so that the several numbers from zero to nine are obtained by partially or totally unmasking, by the movable segments, the underlying figure of eight as represented by the small block.

Now, since with the digital indicator of the invention the different numbers are composed by uncovering, with the movable masking segments, an underlying number of eight in solid outline and possibly with beveled edges, the advantages as to legibility and aesthetic which are thus achieved are clearly apparent.

As a matter of fact, the numbers displayed will no longer be segmentally viewed but in solid lines and, in addition, there is now the possibility of applying a light source from the inside of the indicator in order to illuminate these numbers so as to make them visible also in night time without any light source being visible.

As a matter of fact, according to another feature of the invention, the block shaped in the form of an eight of a transparent plastics material which is light-conductive, has the bottom wall painted with a bright fluorescent varnish, the inner edge treated so as to be mirror-like and the inner edges perfectly smooth, arranged confrontingly to a light source mounted in the interior of the indicator box.

By so doing, the light emitted by the source enters through the inner edges of the small block and is reflected by the outer mirror-like edges of the block, whereafter it excites the fluorescent paint with which the block bottom wall has been treated so that the displayed number can be viewed in night time also.

Lastly, according to still a further feature of the present invention, the eight-shaped block of a transparent and light-conductive plastics material is extended downwards like a mushroom with a vertical stalk, also of a transparent and light-conductive plastics material and a light source is located in correspondence with the free front end of such a vertical stalk.

This latter approach has the advantage of permitting that a single light source may be used for illuminating a number of digital indicators simultaneously.

The invention is now better elucidated with reference to the accompanying drawings which show a preferred practical embodiment which is described by way of example only without limitation, since technical and constructional modifications can be introduced therein without departing from the scope of the present invention.

In the drawings:

FIG. 1 shows a top plan view of three digital electromagnetic indicators made according to this invention, these indicators displaying three different positions of the seven movable segments, and more detailedly:

FIG. 1*a* with all seven movable masking segments in their stable position which corresponds to "in-view" or active segments.

FIG. 1*b* with all seven movable masking segments in their stable position which corresponds to "out-of-view" or inactive segments, displaying the number eight, and FIG. 1*c* with two movable segments only in view and the other five out-of-view, to display the number five.

Figure 5:
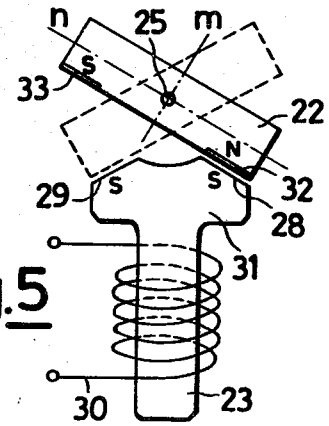
Figure 4:
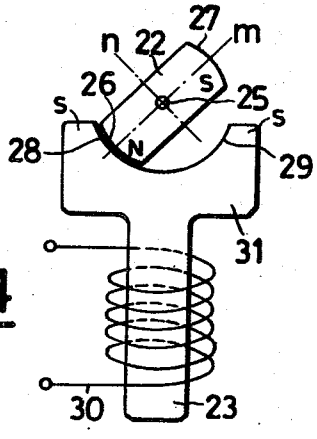

FIG. 4 diagrammatically shows in front cross-sectional view a modification, according to the invention, of the electromagnetic circuit for driving the angular stroke of the masking movable segments, and FIG. 5 diagrammatically shows in front cross-sectional view another modification according to the invention of the electromagnetic circuit for driving the angular stroke of the movable masking segments.

Figure 2:
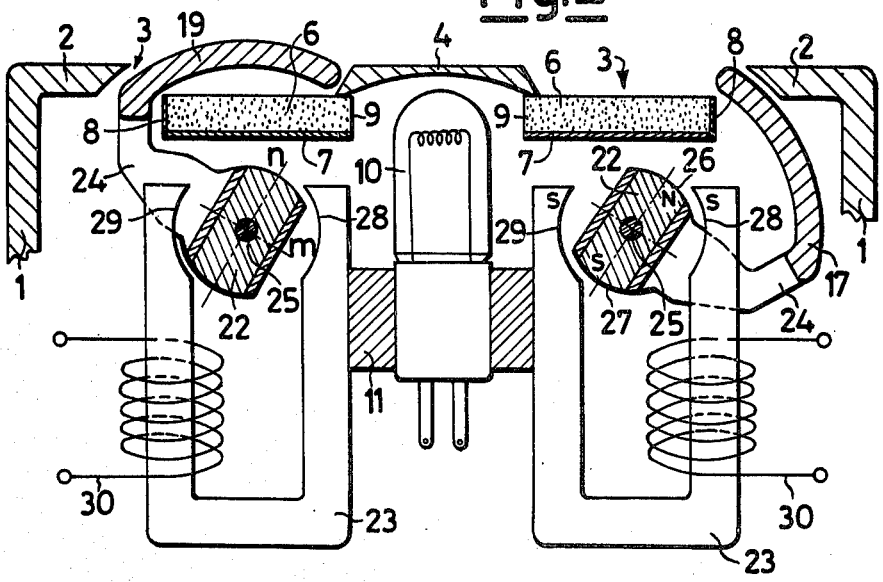
FIG. 2 shows a front diagrammatical cross-sectional view, fragmentary and on an enlarged scale, of the indicator according to line A—A of FIG. 1*c*.
Figure 3:
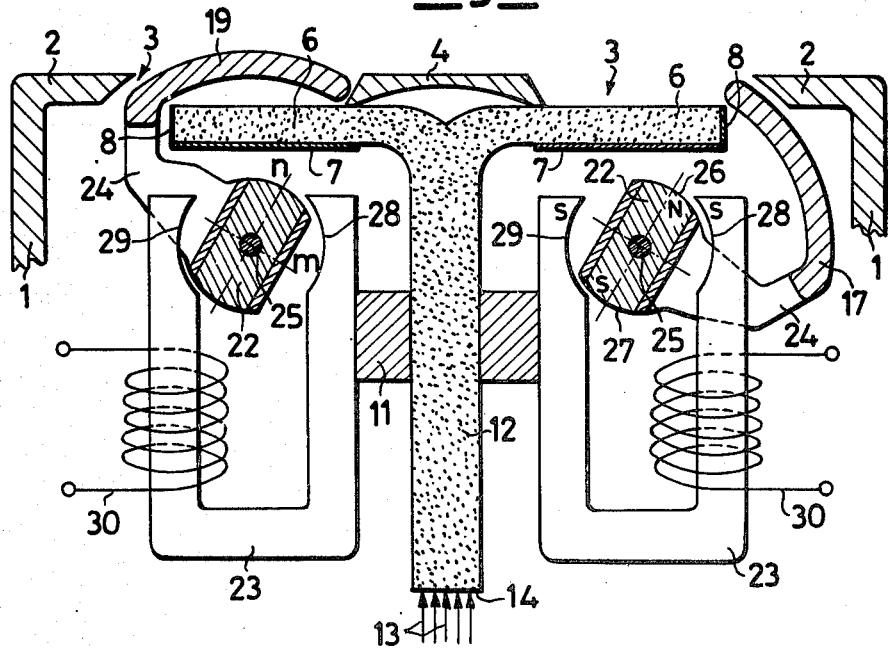
FIG. 3 shows a diagrammatical fragmentary diagrammatical cross-sectional view on an enlarged scale of a modification of the indicator according to the invention, taken along the line A—A of FIG. 1*c* again.

Having now reference to the drawings, in which like numerals connote like component parts, the numeral 1 indicates the box of the electromechanical digital indicator on the top plate of which, 2, a continuous slit or window, 3, in the shape of a figure of eight, has been formed. Such a 8-shaped continuous windows is substantially obtained from a single slit having the shape of a parallelogram by the agency of two removable lids, 4 and 5, which, supported by the box 1 with means not shown in the drawings, delimit the inner edges of the figure of eight of the window. In correspondence with said continuous window 3 and in the interior of the box 1, there is mounted a single block 6 of a transparent and light-conductive plastic material. This block, shaped in a figure-of-eight outline similarly to the continuous window 3, is supported by the box 1 with means which are not shown in the drawings. The block 6 has its bottom wall 7 painted with a bright fluorescent varnish, the outer edges 8 are treated in a mirror-like fashion and thus they are highly reflecting, while the inner edges 9 (best seen in FIG. 2) smoothed flush and placed confrontingly relative to a light source 10 which is supported in the interior of the box 1 by a supporting slug 11 integral with the box 1, beneath the removable lids 4 and 5. Thus, from the top of the digital indicator it is always possible to view quite clearly, even at night time, a "number of eight" in solid lines and in brilliant color. Conversely, according to the modification shown in FIG. 3, the block 6 in the shape of an "eight" is extended downwards somewhat in the shape of a mushroom with a vertical stalk, 12, made also of a transparent and light-conductive plastics material which is supported by the supporting slug 11 and illuminated by the light 13 emitted by a light source placed in registry with the free front end 14 of the block 6.

Figure 1C:
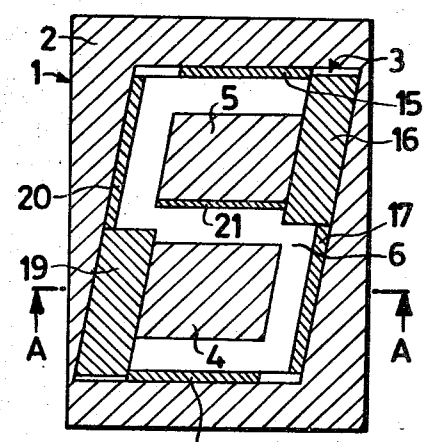
Figure 1B:
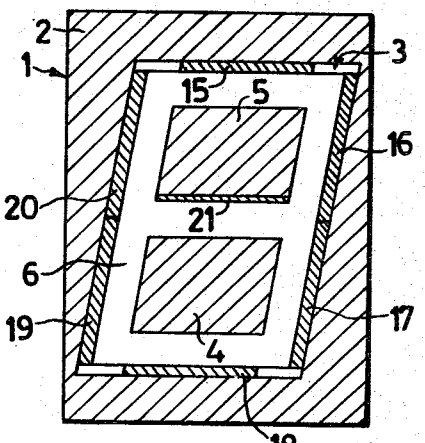
Figure 1A:
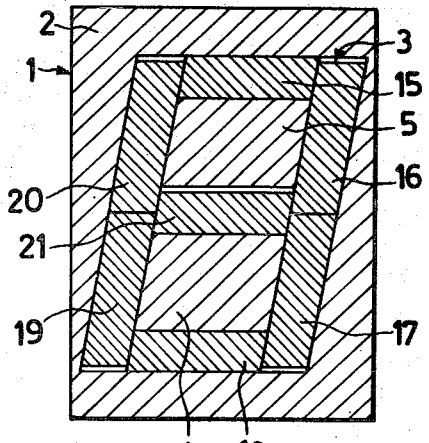

The bright-colored number eight displayed by the block 6 can subsequently be totally (see FIG. 1*a*) or partially (see FIG. 1*c*) masked by seven movable masking segments of the continuous window 3, which are 15, 16, 17, 18, 19, 20, and 21, respectively, and can angularly be shifted from a stable position corresponding to the inactive or out-of-view segment (best seen as segment 17 in FIGS. 2 and 3), to a likewise stable position corresponding to a segment in view or active (best seen as segment 19 in FIGS. 2 and 3), or vice versa. By properly driving the movable segments aforementioned so as to uncover in the appropriate manner the underlying figure of eight as shown by the block 6, it becomes thus possible to obtain all the numbers from zero to nine. These, as best seen in FIG. 1*c*, are no longer in segmental form but in solid lines.

The appropriate angular stroke of each of the seven movable segments 15–21 is produced by a driving electromagnetic circuit: the latter is essentially composed by a permanent magnet 22 and by an electromagnet 23. More precisely, each of the movable segments 15–21 is extended into the interior of the box 1 by a stalk 24 (best seen in FIGS. 2 and 3), the other end of such a stalk being made integral with a permanent magnet 22 which is hinged centrally with respect to its central axes m and n on a pivotal pin 25. Pin 25 is supported by the box 1 through means not shown in the drawings. The two front ends 26 and 27 of the magnet 22, which are magnetized with a North and a South polarity, respectively, are in confronting relationship with, and are respectively encompassed by the two pole shoes 28 and 29, of an electromagnet 23. The electromagnet 23 has substantially a "U," or a hairpin shape and is energized by current pulses which are caused to flow through its energizing coil 30. It is thus apparent that, consistently with the direction along which the current pulses are delivered to the coil 30, the pole shoes 28 and 29 of the electromagnet will be, both, magnetized as North or South, so that they will attract the front end of the magnet which has a South or a North polarity, respectively, while they will simultaneously and respectively reject (twofold magnetic effect) the other end of the magnet, so that the magnet will be compelled to swing about its pivotal pin 25.

In the Figures of the drawings, it has been assumed that the direction of the current pulses is such as to originate a South magnetic polarity on the pole shoes 28 and 29. As a result, the North pole of the front end 26 of the magnet 22 will be sucked, whereas the South pole of the other front end will be rejected. The magnet 27 and thus the movable segment 17 integral therewith, will then be swung clockwise about the pin 25 until attaining the stable position as represented by the drawings and corresponding to the inactive, or out-of-view segment. By reversing the direction of the current pulses, the magnet 22 and the movable segment 17 will, conversely, be swung anticlockwise towards the alternative stable position which corresponds to the active or "in-view" segment which thus masks the relevant portion of the underlying number eight as represented by the block 6. The rotation in either direction of the movable segments 15–21 is thus blocked in correspondence with such stable positions by mechanical abutments or stops which are not shown in the drawings. Such stops cooperate with the stalks 24 of the segments, whereas the pole shoes 28 and 29 are so sized as continually to encompass the magnetized front ends 26 and 27 of the permanent magnet 22 along the entire arc of circle as described by each end when being shifted from either stable position to the other.

Conversely, according to the alternative embodiment shown in FIG. 4, the magnetized front ends 26 and 27 of the permanent magnet 22 are caused to cooperate with the pole shoes 28 and 29 of an electromagnet 23 which has substantially the shape of a "tee" (T), which shoes are formed on upward extensions of the ends of the wings 31 of the electromagnet and do not encompass completely the magnetized front ends 26 and 27 along the arc of circle mentioned above.

Lastly, according to the modification shown in FIG. 5, the permanent magnet 22 is not magnetized in correspondence with its front ends, but, rather, in correspondence with its bottom lateral ends 32 and 33 which are in confronting relationship and cooperate with the two pole shoes 28 and 29 of an electromagnet 23 having substantially the shape of a "tee." The pole shoes are represented by the beveled top ends of the wings 31 of the electromagnet 23. FIG. 5 also shows, in phantom, the position that the permanent magnet 22 will take in correspondence with its other stable position.

I claim:

1. An electromechanical digital indicator, comprising a box on the top plate of which are formed seven slits or windows arranged in the fashion of a figure-of-eight as the sides of two superposed parallelograms, in correspondence of which there can be caused to appear or disappear seven angularly movable segments, the angular displacement of each movable segment from a stable position corresponding to an inactive or out-of-view segment to another stable position corresponding to an active or in-view segment, or vice versa being obtained by the agency of a driving electromagnetic circuitry composed by a permanent magnet which, hinged in the inside of such a box and integral with said movable segment, magnetically cooperates with an electromagnet also contained in said box, characterized in that said permanent magnets of the driving magnetic circuits of the angular displacements of said movable segments to which they are solidly fastened, are centrally hinged with respect to their central axes, each between the two pole shoes of an electromagnet which has substantially the shape of a "U," which shoes confront respectively the two magnetized front ends of said permanent magnet and encompass them along the entire arc of circle described by the angular displacement of the movable segment integral with the permanent magnet.

2. An electromechanical digital indicator according to claim 1, characterized in that the seven slits or windows formed through the top plate of the box extend the one into the other so as to constitute a single continuous slit or window in the shape of an "eight", in correspondence with which and beneath said movable segments there is mounted in the interior of the box a block of a transparent and light-conductive plastics material shaped in the form of an "eight" in a manner similar to that single slit or window, the several numbers from zero to nine being obtained by partially or totally unmasking with the aid of said movable segments, the underlying number "eight" as represented by said block.

3. An electromechanical digital indicator according to claim 2, characterized in that the eight-shaped block of a transparent and light-conductive plastics material has its bottom wall painted with a bright fluorescent varnish, the outer edges treated in a mirror-like manner and the inner edge flush smooth and confronting a light source mounted in the interior of the indicator box.

4. An electromechanical digital indicator according to claim 2, characterized in that the eight-shaped block of a transparent and light-conductive plastics material, is extended downwards somewhat in the way of a mushroom with a vertical stalk also of a transparent and light-conductive plastics material, a light source being placed in correspondence with the free front end of said vertical stalk.

5. An electromechanical digital indicator according to claim 1, characterized in that said permanent magnets of the electromagnetic control circuits for driving the angular displacements of said movable segments with which they are integral, are hinged relative to their central axes and cooperate, each, with an electromagnet which has substantially the shape of a "T," the ends of the wing of the "T" are extended upwards into two pole shoes which confront one another in correspondence with the magnetized front ends of said permanent magnet but without encompassing them completely along the entire arc of circle described by the angular displacement of said movable segment integral with said permanent magnet.

6. An electromechanical digital indicator according to claim 1, characterized in that said permanent magnets of the electromagnetic circuitry for the control of the angular displacements of said movable segments to which they are fastened, are centrally hinged relative to their central axes and cooperate, each, with an electromagnet which has substantially the shape of a "T" having two pole shoes in respective correspondence with the two top beveled end of the wing of the "T," said permanent magnet being magnetized in correspondence with its bottom lateral ends which confront such pole shoes.

* * * * *